US010870304B2

(12) United States Patent
DeVries et al.

(10) Patent No.: US 10,870,304 B2
(45) Date of Patent: Dec. 22, 2020

(54) ALTERNATING WET CLEANING AND DRY CLEANING OF A FLEXOGRAPHIC PRINTING PLATE

(71) Applicants: Jeffrey M. DeVries, Avon Lake, OH (US); Robert Hershfeld, Parkton, MD (US)

(72) Inventors: Jeffrey M. DeVries, Avon Lake, OH (US); Robert Hershfeld, Parkton, MD (US)

( * ) Notice: Subject to any disclaimer, the term of this patent is extended or adjusted under 35 U.S.C. 154(b) by 118 days.

(21) Appl. No.: 15/914,290

(22) Filed: Mar. 7, 2018

(65) Prior Publication Data

US 2018/0257420 A1 Sep. 13, 2018

Related U.S. Application Data

(60) Provisional application No. 62/468,084, filed on Mar. 7, 2017.

(51) Int. Cl.

| | |
|---|---|
| ***B08B 3/02*** | (2006.01) |
| ***B41N 3/00*** | (2006.01) |
| ***B08B 1/00*** | (2006.01) |
| ***B08B 3/08*** | (2006.01) |
| ***B41F 35/02*** | (2006.01) |

(52) U.S. Cl.

CPC ..... *B41N 3/006* (2013.01); *B08B 1/008* (2013.01); *B08B 3/022* (2013.01); *B08B 3/024* (2013.01); *B08B 3/08* (2013.01); *B41F 35/02* (2013.01); *B41P 2200/12* (2013.01); *B41P 2235/24* (2013.01); *B41P 2235/26* (2013.01)

(58) Field of Classification Search

CPC ..... B41N 3/006; B08B 1/008; B08B 3/022; B08B 3/024; B08B 3/08; B41F 35/02; B41P 2200/12; B41P 2235/24; B41P 2235/26

See application file for complete search history.

(56) References Cited

U.S. PATENT DOCUMENTS

| | | | | |
|---|---|---|---|---|
| 5,575,211 | A * | 11/1996 | Harrison | B41F 35/02 101/423 |
| 9,302,465 | B2 | 4/2016 | Roberts et al. | |
| 2015/0090142 | A1 * | 4/2015 | Roberts | B41F 35/02 101/425 |

* cited by examiner

*Primary Examiner* — Tinsae B Ayalew
(74) *Attorney, Agent, or Firm* — Perman & Green, LLP

(57) ABSTRACT

An apparatus comprises a plate cleaner assembly. The plate cleaner assembly further comprises a frame, a roller coupled to the frame, a dry cleaning material coupled to the roller, and a spray assembly coupled to the plate cleaner assembly. The plate cleaner assembly further includes a controller coupled thereto. Moreover, the apparatus further comprises a printing plate cylinder and a printing plate coupled to the printing plate cylinder.

18 Claims, 3 Drawing Sheets

STEP 1: PRINTING PLATE WETTING

STEP 2: WIPING OF WETTED PRINTING PLATE

ALTERNATING WET CLEANING AND DRY CLEANING OF A FLEXOGRAPHIC PRINTING PLATE

PRIORITY CLAIM

The present application claims priority to U.S. Provisional Application No. 62/468,084, filed on Mar. 7, 2017.

FIELD OF THE INVENTION

The present invention relates generally to flexographic printing machines and systems. More specifically, the present invention relates to a combined wet cleaning and dry cleaning apparatus and assembly that is used for wet cleaning or dry cleaning of the outer surface of a flexographic printing plate as the plate rotates on a plate cylinder. It also relates to a method that is drawn to such an apparatus and assembly that utilizes an interface to at least one controller that is incorporated into the apparatus and assembly of the present invention.

BACKGROUND OF THE INVENTION

In the art of flexographic printing, a plate is carried on a rotating cylinder. The plate carries a print medium that is then applied to a surface. During the printing process, certain debris, such as dust, paper fibers, and other residue, is unavoidably deposited onto the plate. This type of debris can result in poor print quality and needs to be removed from the plate to maintain optimum print quality. It is also desirable to remove such debris without having to shut down the printing press during a production run because doing so adversely impacts productivity. That is, it is known in the prior art that shutting down the press to manually wipe debris from the printing plate accomplishes the intended purpose, but at the expense of lowering print production. Other methods are known in the art that use a more mechanized process for cleaning a printing plate, but do so by degrading the surface of the printing plate by repeated cleanings and imprecise placement of a cleaning device relative to the printing plate. These mechanized processes of the prior art also result in a degradation of print quality due to the degradation of the surface of the printing plate. A "dry" system is preferred in that it minimizes color deviation in the ink and produces no waste water, which then needs to be properly disposed of. One such system is disclosed and claimed in U.S. Pat. No. 9,302,465 to Roberts et al. titled Apparatus, Assembly and Method for Dry Cleaning a Flexographic Printing plate Carried on a Plate Cylinder that Includes Optimized Cleaning Functionalities, which is incorporated herein by reference in its entirety.

However, it is also desirable to utilize a "wet" system to lay down a coating of solvent onto the printing plate, preferably following the print run. The solvent may be water or a chemical solvent, although examples are not so limited This would wet clean the printing plate and the dry cleaning apparatus and assembly would clean and dry the plate prior to the plate being stored following the production run. During the production run, the printing plate would be dry cleaned as described above. However, even during a production run, it may be necessary for the operator to interrupt the dry cleaning and production process, for whatever reason. When that happens, ink may dry on the printing plate. Because this dried ink will negatively impact print quality when production is resumed, it is also desirable to remove this dried ink during that print interruption using the wet cleaning process, which eliminates a manual wash by an operator and thereby improves productivity and reduces labor costs.

Accordingly, it is an object of the present invention to provide an apparatus, assembly, and method for initiating printing plate wetting of a flexographic printing plate, followed by dry cleaning of the plate, as needed during a production run. It is another object to provide such an apparatus, assembly, and method whereby the plate wetting and dry cleaning process can be used to clean the printing plate prior to storage of the plate for future use. It is still another object to provide such an apparatus, assembly, and method whereby the plate wetting components can be easily removed from the printing press for service and maintenance when necessary.

SUMMARY OF THE INVENTION

The plate wetting and dry cleaning apparatus, assembly, and method of the present invention has obtained these objects and others. It provides for a plate wetting subassembly that works in conjunction with a dry flexographic plate cleaner apparatus. During use of the plate wetting subassembly, the cleaning head will pass across the printing plate to wet and clean the plate. This may be repeated, if necessary. To ensure that the entire plate is wetted, the cleaning head that the plate subassembly is used with dwells at a starting position for one revolution of the print cylinder. Thereafter, the cleaning head and plate wetting subassembly will move across the plate until it reaches an ending position at which point the plate wetting subassembly will dwell for one revolution of the print cylinder.

The plate wetting subassembly can be used during an interrupted print run or at the end of a print run, using the dry cleaner portion to pass over and absorb the solvent deposited on the plate. Before beginning a cleaning pass, it would be advisable to advance the cloth of the dry cleaning head so that the wet cleaning is not started with an already soiled cloth. Likewise, at the end of the clean, it is advisable to advance the cloth so that the normal cleaning cycle is not started with dirty wet cloth. It may also be advisable to advance the cloth take-up in a way that is faster than usual to fully absorb the deposited solvent. The dry cleaning assembly, by contrast, may be used during printing; that is, the dry cleaning assembly may be used when the system is in a printing mode. The dry cleaning assembly may serve to remove foreign objects and ink from the printing plate during a print run, while the wet cleaning subassembly may be used to more thoroughly clean the printing plate of ink and other debris upon completion of the printing run. Additionally, the apparatus, assembly, and method of the present invention also provides for use of at least one controller for electronically controlling the wetting subassembly in accordance with the method and implementing optimized cleaning capabilities and functionalities.

The foregoing and other features of the apparatus, assembly, and method of the present invention will be apparent from the detailed description that follows.

DETAILED DESCRIPTION

Figure 1:
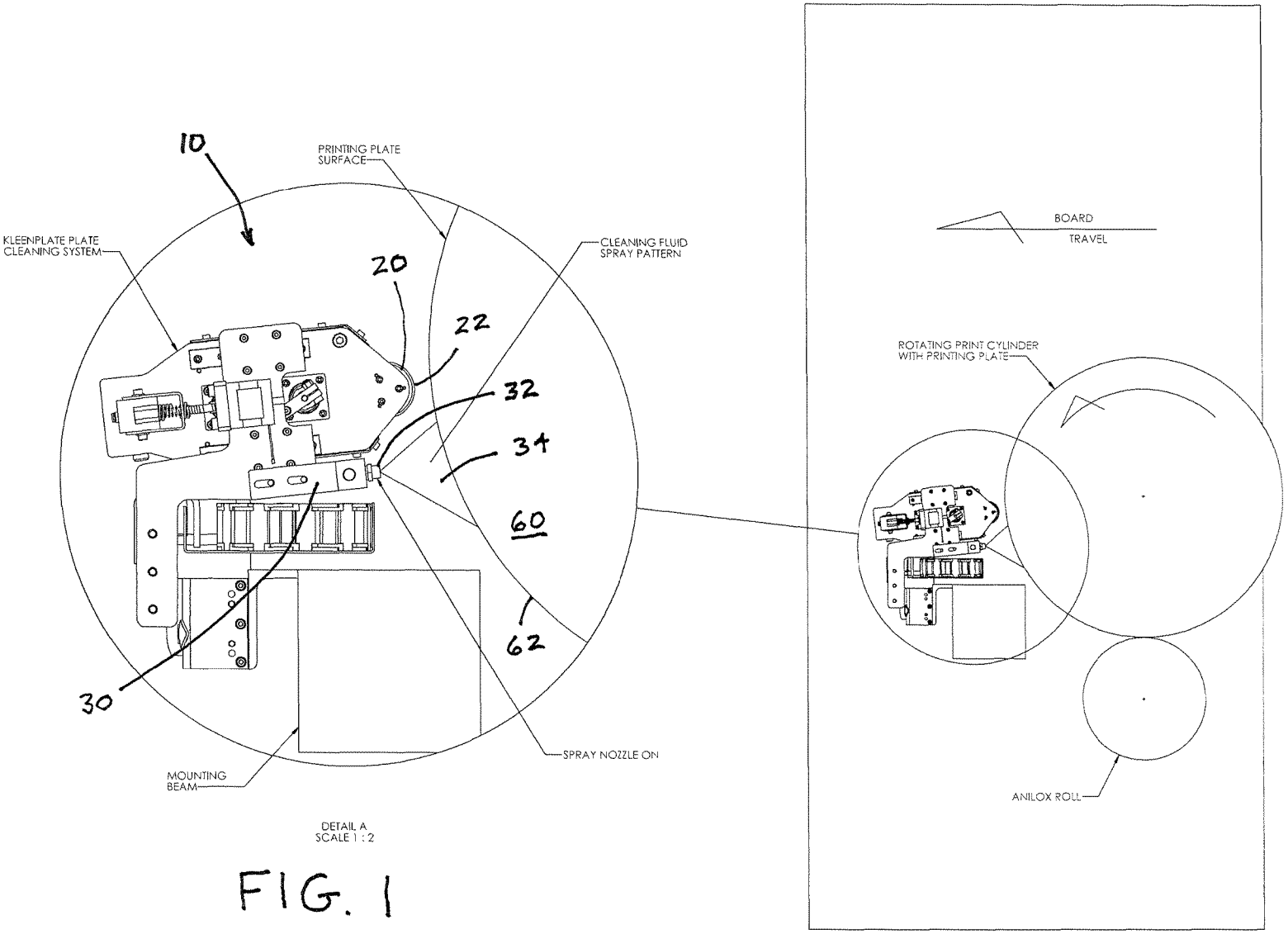
FIG. 1 is a side elevational view of a cleaning head using the wetting subassembly of the present invention with spray nozzle "on" and the dry cleaning apparatus and assembly in a "clear" position where it is not engaged with the printing plate in accordance with the present disclosure.
Figure 2:
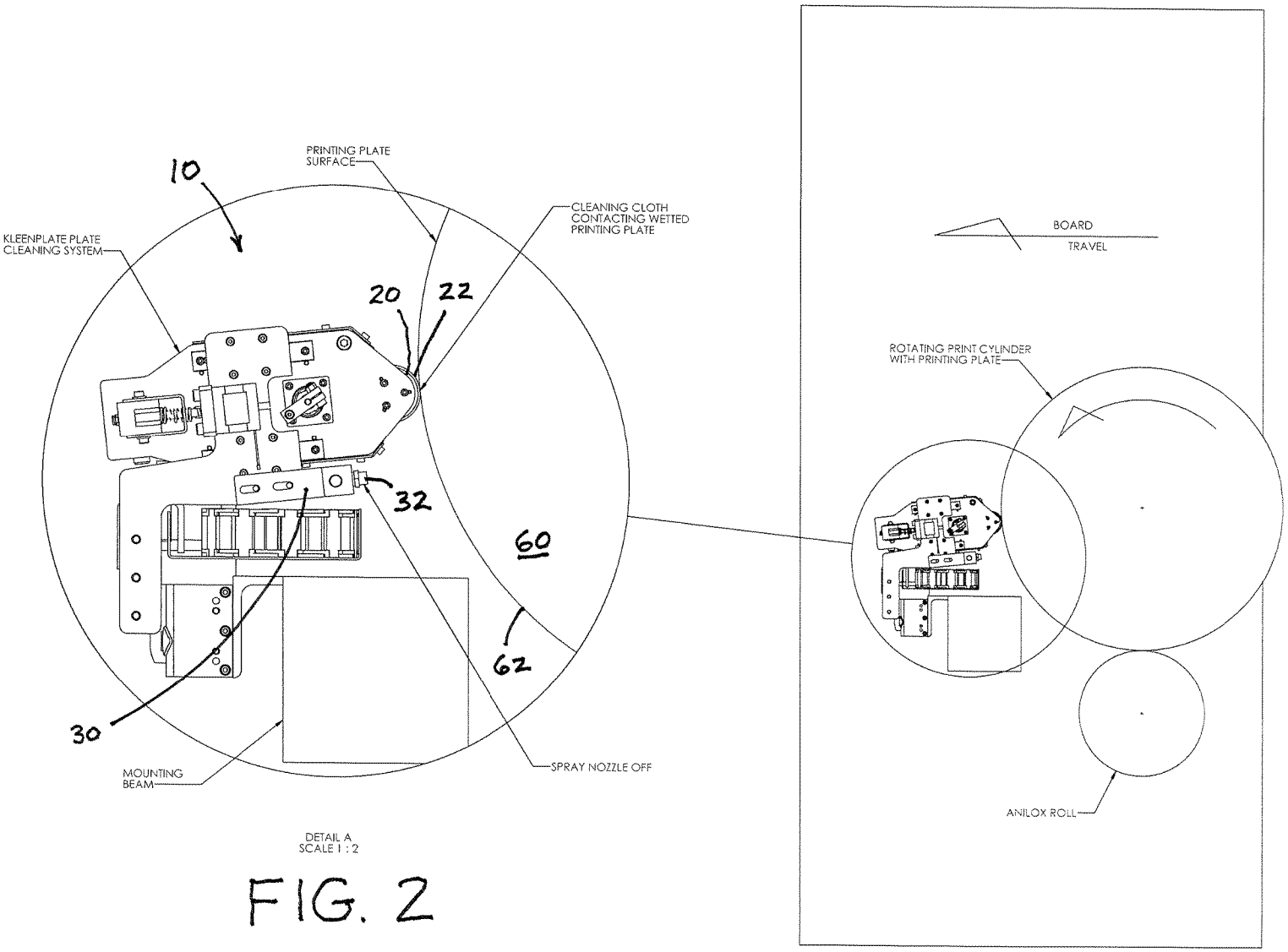
FIG. 2 is a side elevational view similar to FIG. 1 but showing the spray nozzle "off" and the dry cleaning apparatus and assembly engaged with the wetted printing plate in a "cleaning" position to absorb water or other solvent using the dry cleaning material as it passes over the printing plate.

Referring now to the drawing views in detail, wherein like numbered elements refer to like elements throughout the drawings, FIGS. 1 and 2 illustrate a preferred and representative embodiment of a printing plate cleaner structure (or "plate cleaner"), generally identified 10, of a dry cleaning apparatus and assembly that is fabricated in accordance with the present invention.

As shown, the plate cleaner 10 comprises a frame having multiple motors—a linear actuator motor, a cloth rewind motor, and an impression, or "tilt", motor. It is to be understood that such motors may be one motor or any combination of motors, from a group consisting of electric motors, hydraulic motors, pneumatic motors, and the like, the type of motor(s) used not being a limitation of the present invention.

The frame of the plate cleaner 10 also comprises a roller 20 and dry cleaning material 22 that passes over the roller 20. During normal use, the plate cleaner 10 moves laterally and along the surface of a printing plate 62 that is secured to a print cylinder 60. That is, the roller 20 has an axis that is parallel to that of the printing plate cylinder 60. The roller 20 is also that structure of the plate cleaner 10 over which a portion of dry cleaning material 22 is pulled, the dry cleaning material 22 being fed from a web of such material that is disposed within the plate cleaner 10. It is also within the scope of the present invention to provide a version of the plate cleaner 10 having a roller 20 that adjusts its impression using an eccentric cam on its roller shaft (not shown). This version allows for a smaller footprint and provides more versatility to the functionality of the plate cleaner 10.

In the preferred embodiment, the plate cleaner 10 comprises an "unwind" spindle (not shown) that carries the web of unsoiled dry cleaning material, such as a woven or non-woven polyester, or any other absorbent cloth or cloth-like material. Another spindle (also not shown) is a "rewind" spindle that pulls the web of dry cleaning material from the unwind spindle about a portion an outer surface of the roller 20 and back to the rewind spindle. At the point of return to the rewind spindle, the dry cleaning material 22 is soiled with printing debris and ink, as described above.

However, it is to be understood that the exact placement of the rewind and unwind spindles relative to the assembly of the present invention is not a limitation of the present invention. That is, different configurations of the spindles are available depending on the specific application and use to which the plate cleaner 10 of the present invention is desired or required. However, the functionality of the pulling of the dry cleaning material 22 from an unwind spindle across a portion of the roller 20 and back to a rewind spindle is required regardless of placement of those structures within the plate cleaner 10. It is also intended that the axes of the roller 20 and the spindles be parallel with the axis of the print plate cylinder 60, although the spindles could be used with other structures to accomplish feeding or take-up of the unsoiled or soiled dry cleaning material, respectively.

A linear actuator motor provides a means for moving the plate cleaner 10 longitudinally along a track system (not shown) that is also parallel to the axis of the print plate cylinder 60. An impression, or "tilt", motor allows the roller 20 of the plate cleaner 10 to move toward and away from the surface of a printing plate 62 that is attached to the print cylinder 60. This last structure is significant in that it provides functionality such that relatively tight or precise control of the pressure that the plate cleaner roller 20 places on the printing plate 62 as the printing plate 62 and the print cylinder 60 rotate is attained. This allows the cleaning roller 20 and the material 22 (also referred to herein as a "web") to be moved closer to or further from the surface of the printing plate 62 for optimized spacing and cleaning of that surface, thereby placing more or less pressure on the printing plate. This also allows the operator to make position and pressure adjustments between the plate cleaner and the print plate without the need to stop the printing press or the printing process.

Referring specifically to FIG. 1, it shows a spray subassembly 30 that is attached to the plate cleaner 10. The spray subassembly 30 comprises a nozzle 32 which draws solvent from a supply (not shown) and deposits a spray pattern of solvent 34 onto the plate 62. During the depositing of the water 34 onto the plate 62, the plate cleaner 10 is moving laterally along the plate 62. FIG. 2, however, shows the ceasing of spray from the nozzle 32 and engagement of the roller 20, as well as the web 22 passing over the roller 20, such that the web 22 absorbs the solvent and removes wetted debris from the plate 62.

Figure 3:
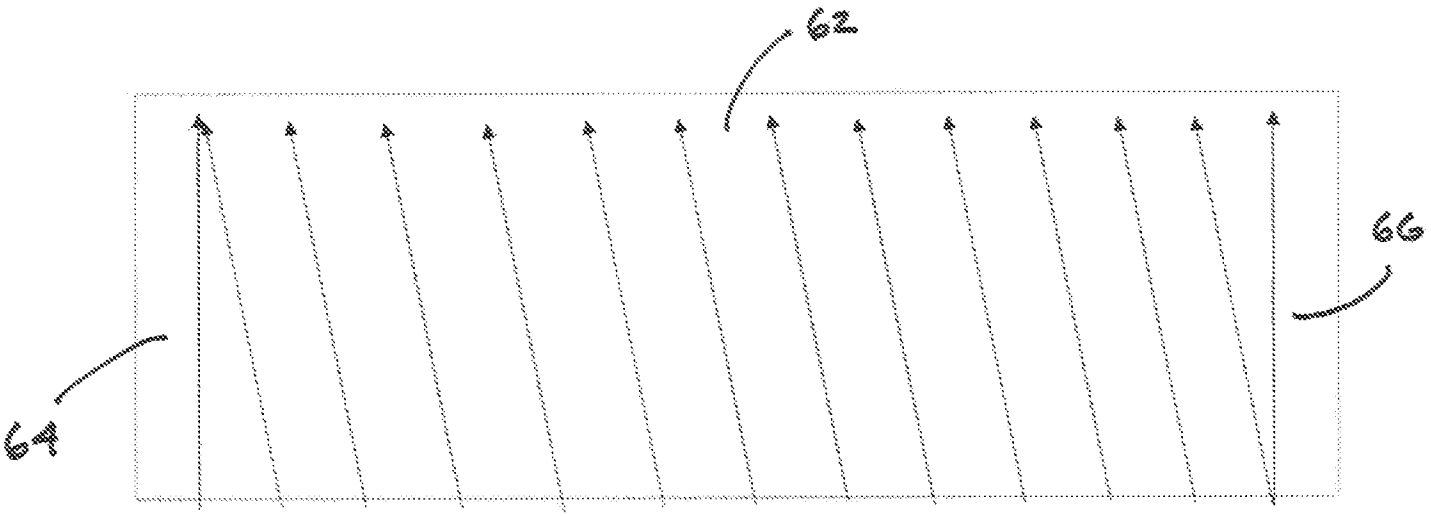
FIG. 3 is a representative schematic illustrating a travel path for the cleaning apparatus relative to a print cylinder and plate disposed on the print cylinder.

In application, the solvent may be sprayed directly onto the web 22 by the nozzle 32. Once the web 22 has been wetted, the roller 20 may pass over the plate 62, allowing the wetted web 22 to wipe the plate 62. In some examples, the roller 20 may be oscillated with respect to the plate 62. Said differently, the roller 20 may be moved while passing the wetted web 22 over plate 62. This may result in a "scrubbing" action by the roller 20 and therefore, by the wetted web 22. In such examples, the roller 20 may oscillate in alternating movement by forward and backwards directions. The roller 20 may pass over the plate 62 in a pattern similar to the pattern shown in FIG. 3.

As alluded to above, the present invention further provides an electronic controller (not shown) that utilizes a controller network interface and an electronic control unit to monitor and control the cleaner, either directly or in accordance with a pre-programmed scheme. The electronic controller uses programmable instructions to determine operational parameters and institute electronic commands to the electronic control unit in a pre-determined response operational framework. When the controller is enabled, it monitors certain operational parameters of the plate cleaner 10 and the wetting subassembly 30. In the controller of the present invention, the operational parameters are configurable, allowing the setup to be optimized for a particular method of operation, regardless of the specific application that the plate cleaner is used for, and is programmable to make adjustments accordingly.

Continuing, and when traversing across the plate 62, the head 10 should advance at a rate of one spray-pattern width per print cylinder revolution. An exemplary programmable feature, such as "Number of Wipes" to slow down the head 10 in the event that more water is needed, can be included. During this first pass, the head 10 should stay at the "clear" position. Once wetting of the plate 62 is complete, the head 10 should return to its starting point to begin the cleaning process. It is desirable to add the ability to preset a dwell time between the wetting and cleaning cycle.

On the second pass, the plate cleaner 10 will traverse the printing plate 62 with the head 20 and web 22 at the "cleaning" position. An independent pressure setting for the cleaning may be programmed if the pressure applied needs to be greater or lesser than the standard pressure for normal cleaning. Once again, the head 20 should dwell for one revolution at the beginning and end of travel so that the entire plate 62 is cleaned. Preferably, the head 20 should advance across the plate 62 at a rate of 100 millimeters per revolution of the print cycle. Another programmable feature, such as "Number of Wipes", can be added to slow down the head 20 in case that is needed. It may be necessary to repeat the wetting and cleaning pass cycle multiple times to get the plate 62 to its desired level of cleanliness.

Before beginning the cleaning pass, it is also preferred to advance the web 22 a distance so that it is not starting the wet clean with an already soiled cloth. Likewise at the end of the cleaning pass, it is preferred to advance the web 22 so that the plate cleaner 10 does not start its normal cleaning cycle with a dirty wet cloth, as this could adversely impact print quality. It may also be desirable to advance the web 22 faster during the wet cleaning cycle.

It would be preferred that the spray nozzle 32 work at standard water pressures so that the subassembly 30 can be plumbed into the press water supply lines, as opposed to requiring a separate tank that must be regularly filled and maintained.

In accordance with the preferred embodiment, the controller of the present invention also comprises a number of automated and enhanced cleaning functionalities that may be included with the base apparatus, system, and method of the present invention. Each functionality is intended to interface with the electronic controller of the present invention to enhance overall operation and optimization of the apparatus, system, and method of the present invention. In accordance with the foregoing, programmable inputs from the processor may include:

Press Speed; and

Print Unit Ready Signal.

Programmable inputs on a "wet clean setup" screen may include:

Spray pattern width (measured at setup);

Cloth advance time before starting clean;

Cloth advance time after finishing clean; and

Repeat diameter (from system setup screen.

Programmable inputs on a "wet clean operator" screen may include:

"Number of Wipes" for water spraying;

"Number of Wipes" for cleaning;

Cleaning width (from EditKleen screen);

Pressure setting;

Dwell time between wetting and cleaning;

Number of cleaning cycles; and

Cloth speed.

Further, outputs may include "water valve solenoid per section".

In accordance with the foregoing, an apparatus, assembly, and method is provided for initiating a printing plate wetting of a flexographic printing plate, followed by dry cleaning of the plate, as needed during a production run. The apparatus, assembly, and method is provided such that the plate wetting and dry cleaning process can also be used to clean the printing plate prior to storage of the plate for future use. Further, such an apparatus, assembly, and method can be easily removed from the printing press for service and maintenance when necessary.

The invention claimed is:

1. An apparatus, comprising:

a plate cleaner assembly, wherein the plate cleaner assembly further comprises:

a frame;

a roller coupled to the frame;

a dry cleaning material coupled to the roller such that the dry cleaning material passes over the roller, and a spray assembly coupled to the plate cleaner assembly;

a controller coupled to the plate cleaner assembly;

a printing plate cylinder, and a printing plate coupled to the printing plate cylinder wherein the controller is configured to:

determine a width of a spray pattern by the spray assembly;

determine an amount of time to move the dry cleaning material;

determine an amount of time to elapse between a wet cleaning and a dry cleaning;

determining a number of cleaning cycles;

determine a pressure for a nozzle of the spray assembly to spray solvent; and determine a pressure for the roller to apply to the printing plate.

2. The apparatus of claim 1, further comprising a plurality of motors coupled to the frame.

3. The apparatus of claim 2, wherein the plurality of motors comprises:

a linear actuator motor;

a material rewind motor; and an impression motor.

4. The apparatus of claim 1, further comprising:

a first spindle, the first spindle containing an amount of the dry cleaning material; and a second spindle, the second spindle to pull the dry cleaning material from the first spindle such that the dry cleaning material passes over the roller.

5. The apparatus of claim 1, wherein the plate cleaner assembly moves along an axis parallel to the printing plate cylinder and printing plate by a linear actuator motor.

6. The apparatus of claim 1, wherein the roller moves perpendicular to the printing plate by an impression motor.

7. The apparatus of claim 1, wherein the spray assembly further comprises:

a solvent supply; and a nozzle coupled to the solvent supply, wherein the nozzle draws solvent from the solvent supply.

8. The apparatus of claim 1, wherein the spray assembly moves laterally with respect to the printing plate.

9. The apparatus of claim 2, wherein the controller is further configured to regulate the movement of each motor of the plurality of motors.

10. A plate cleaner apparatus for cleaning a print plate coupled to a printing plate cylinder, the plate cleaner apparatus comprising:

a plate cleaner assembly, wherein the plate cleaner assembly further comprises:

a frame, a roller coupled to the frame, a dry cleaning material coupled to the roller such that the dry cleaning material passes over the roller, and a spray assembly coupled to the plate cleaner assembly; and a controller coupled to the plate cleaner assembly, wherein the controller is configured to:

determine a width of a spray pattern by the spray assembly;

determine an amount of time to move the dry cleaning material;

determine an amount of a printing plate to be cleaned;

determine an amount of time to elapse between a wet cleaning and a dry cleaning;

determining a number of cleaning cycles;

determine a pressure for a nozzle of the spray assembly to spray solvent; and determine a pressure for the roller to apply to the printing plate.

11. The apparatus of claim 10, further comprising a plurality of motors coupled to the frame.

12. The apparatus of claim 11, wherein the controller is further configured to regulate the movement of each motor of the plurality of motors.

13. The apparatus of claim 11, wherein the plurality of motors comprises:

a linear actuator motor;

a material rewind motor; and an impression motor.

14. The apparatus of claim 10, further comprising:

a first spindle, the first spindle containing an amount of the dry cleaning material; and a second spindle, the second spindle to pull the dry cleaning material from the first spindle such that the dry cleaning material passes over the roller.

15. The apparatus of claim 10, wherein the plate cleaner assembly moves along an axis parallel to the printing plate cylinder and printing plate by a linear actuator motor.

16. The apparatus of claim 10, wherein the roller moves perpendicular to the printing plate by an impression motor.

17. The apparatus of claim 10, wherein the spray assembly further comprises:

a solvent supply; and a nozzle coupled to the solvent supply, wherein the nozzle draws solvent from the solvent supply.

18. The apparatus of claim 10, wherein the spray assembly moves laterally with respect to the printing plate.

* * * * *